US005771906A

United States Patent [19]

De Benedictis

[11] Patent Number: 5,771,906

[45] Date of Patent: Jun. 30, 1998

[54] METHOD OF WAVING HAIR

[76] Inventor: Alfredo De Benedictis, 30 Falcon Avenue, Springfield, Milton Keynes, Buckinghamshire, MK6 3HJ, Great Britain

[21] Appl. No.: 704,498

[22] PCT Filed: Feb. 27, 1995

[86] PCT No.: PCT/GB95/00406

§ 371 Date: Aug. 27, 1996

§ 102(e) Date: Aug. 27, 1996

[87] PCT Pub. No.: WO95/22920

PCT Pub. Date: Aug. 31, 1995

[30] Foreign Application Priority Data

Feb. 28, 1994 [GB] United Kingdom ..... 9403790

[51] Int. Cl.[6] ..... A45D 7/04

[52] U.S. Cl. ..... 132/207; 132/222; 132/270

[58] Field of Search ..... 132/222, 273, 132/207, 210, 270, 275, 277

[56] References Cited

U.S. PATENT DOCUMENTS

| | | | |
|---|---|---|---|
| 1,734,961 | 11/1929 | Brown | 132/222 |
| 2,811,159 | 10/1957 | Stanton | 132/222 |
| 3,452,759 | 7/1969 | Sarinelli | 132/270 |
| 3,543,771 | 12/1970 | Altman | 132/222 |
| 3,610,257 | 10/1971 | Hall | 132/270 |
| 3,692,032 | 9/1972 | Regas | 132/270 |
| 3,805,810 | 4/1974 | Savala | 132/270 |
| 5,056,538 | 10/1991 | Matula | 132/222 |
| 5,156,172 | 10/1992 | Tancredi | 132/222 |
| 5,411,040 | 5/1995 | Forrest | 132/222 |
| 5,472,003 | 12/1995 | Frame et al. | 132/273 |
| 5,584,309 | 12/1996 | De Beneditis et al. | 132/210 |

*Primary Examiner*—Todd E. Manahan
*Assistant Examiner*—E. Robert
*Attorney, Agent, or Firm*—Lee, Mann, Smith, McWilliams, Sweeney & Ohlson

[57] ABSTRACT

A device for waving a tress of hair comprises a length of extendible tube formed of elastic material. The tube is provided at each end with gripping means to secure the ends of the tube to the tress of hair. A method of waving a tress of hair comprises the steps of inserting the tress of hair (14) into the elastic tube (11), securing one end of the tube to the tress of hair, extending the tube lengthwise and securing the opposite end thereof to the tress of hair. When the elastic tube is released, the tress of hair contained therein is caused to assume a sinuous waved form. The tress of hair is treated with a chemical substance either prior to insertion in the tube or when in the tube to cause the tress of hair to retain its waved form.

12 Claims, 2 Drawing Sheets

METHOD OF WAVING HAIR

BACKGROUND OF THE INVENTION

This invention relates to treating hair and in particular to a method of waving of hair and a device for carrying out the method.

In known methods of waving or imparting a curl to hair, the hair is rolled onto a roller and subjected to heat and/or to a hair treatment chemical which has the effect of retaining the waving or curling in the hair for a period of time.

SUMMARY OF THE INVENTION

According to one aspect of the invention a device for use in imparting a wave to a tress of hair comprises a tube open at, at least, one end to receive a tress of hair extending lengthwise of the tube; said tube being formed of an elastic material such as to permit said tube to be stretched lengthwise by manually applied force and to return to an unstretched state when the manual force is removed; and first and second gripping means located at locations spaced apart along the tube for securing the tube at said spaced locations to the tress of hair.

According to another aspect of the invention a method of treating hair includes the steps of inserting a tress of hair into a tube of resiliently extendible material; securing the tube at a first lengthwise location thereof to the tress of hair; extending said tube lengthwise; while said tube is so extended, securing the tube at a second location thereof spaced lengthwise of the first location to the tress of hair; permitting the tube to return to an unextended state to thereby cause the hair contained in the tube to assume a waved form; and subjecting the hair contained within the tube to a chemical hair treatment substance effective to retain the hair substantially in said waved form.

BRIEF DESCRIPTION DRAWING

An embodiment of the invention will now be described by way of example with reference to the drawings in which: FIG. 1 shows a first step of the method, FIG. 2 shows a second step of the method, and FIG. 3 shows a third step of the method in accordance with the invention and FIGS. 4*a*, 4*b*, 4*c* and 4*d* show alternative constructions of gripping means on one end of a device for use in the method.

DESCRIPTION OF THE PREFERRED EMBODIMENT

Figure 1:
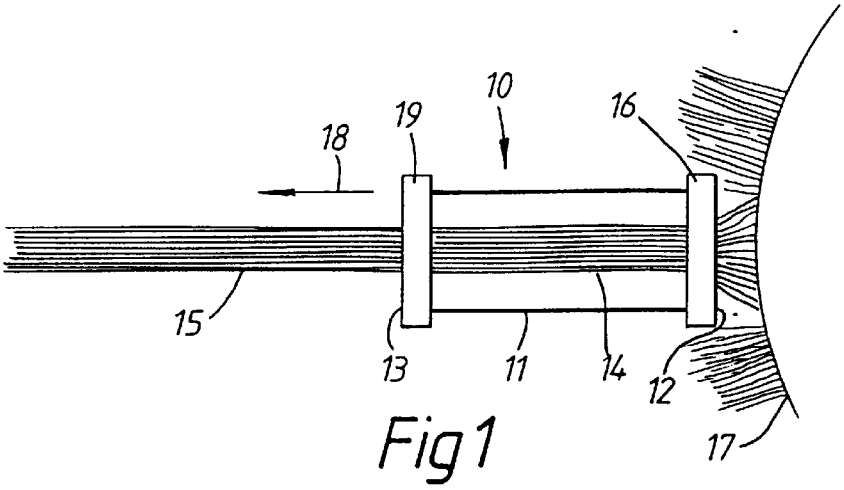
Figure 2:
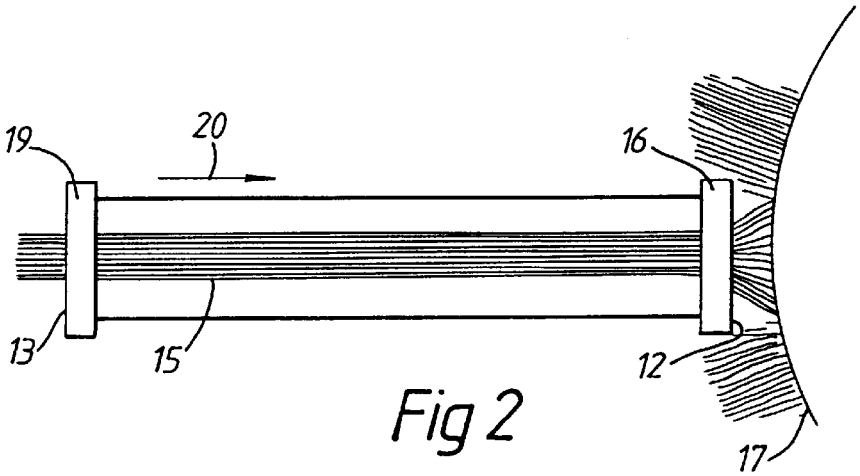
Figure 3:
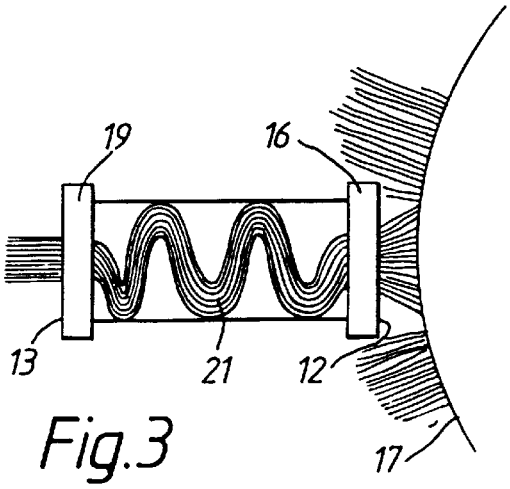

Referring first to FIGS. 1, 2 and 3 the method of treating hair is carried out using a device 10. The device includes a tube 11 of elastic material open at both ends 12, 13. Initially the tube 11 is in an unextended state as shown in FIG. 1 and a tress of hair 14 is inserted such as to extend lengthwise along the tube with a free end 15 of the tress of hair projecting from the end 13 of the tube. A first gripping means 16 is used to secure end 12 of the tube, adjacent the scalp 17, to the tress of hair. The end 13 of the tube is pulled manually in a direction, indicated by arrow 18, away from the scalp 17 such as to extend the tube 11, to an extended state shown in FIG. 2, and thereby cover at least a part of the length of the free end 15 of the tress of hair. When the tube has been extended to a sufficient extent, a second gripping means 19 at the end 13 of the tube is used to secure the end 13 of the tube, while the tube remains held manually in its extended state, to the tress of hair. The gripping means 16 and 19 are effective to secure the ends of the tube to the tress of hair with sufficient force as to prevent slipping of the tress of hair relative to the ends of the tube.

When the end 13 of the tube is released, thereby removing the force holding the tube in its extended state, the tube contracts lengthwise such that the end 13 moves in the direction of arrow 20 and thereby draws the hair gripped at the end 13 of the tube toward the hair gripped at the end 12 of the tube. As a consequence the Length of the tress of hair contained within the tube is forced to occupy an overall length shorter than that of the tress of hair when lying straight and the tress of hair takes up a generally sinuous form 21, as shown in FIG. 3, within the confines of the contracted tube 11.

Prior to inserting the tress of hair into the tube, the tress of hair is treated with a chemical hair treatment substance effective to cause the hair to be retained in a form into which the tress of hair has been set. Accordingly, the hair treatment substance acts to cause the hair to retain the sinuous form into which it is set as a result of being contained within the tube and by subsequent contraction of the tube.

Preferably the tube is perforated, or is air permeable, order to permit free exchange of air between the interior and exterior of the tube during extension and contraction of the tube. If desired, instead of applying the hair treatment substance to the tress of hair prior to insertion of the tress of hair into the tube, the hair treatment substance may be applied through the perforations into the interior of the tube after the hair has been inserted into the tube either before or after the hair has been set into the sinuous form by contraction of the tube.

After elapse of a time sufficient for the chemical treatment substance to act on the tress of hair, the gripping means 16, 19 are released and the device 10 is removed from the tress of hair. Any operation required to neutralize and/or remove the treatment substance from the tress of hair is then carried out.

It will be appreciated that the tube is formed such as to be stretchable lengthwise from an unextended state to an extended state by application of an extending force and to contract back from the extended state to or towards its original unextended state upon removal of the extending force. Conveniently the tube may be formed of thin rubber or latex but if desired may be formed of other materials or be constructed of a combination of materials.

Figure 4A:
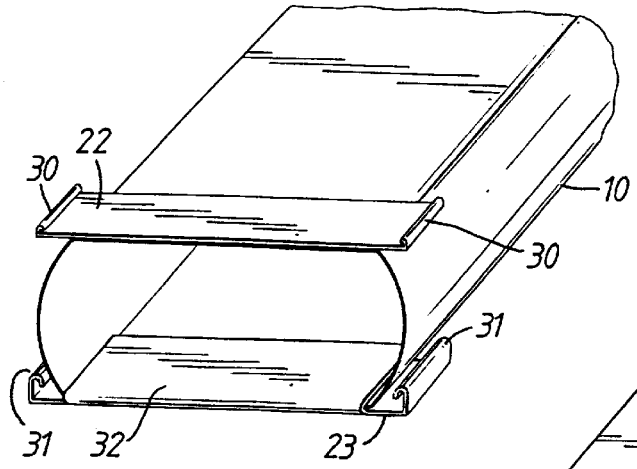
Figure 4B:
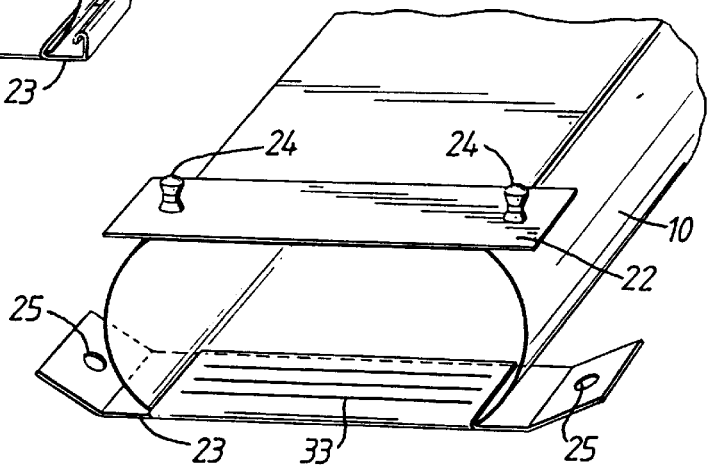
Figure 4C:
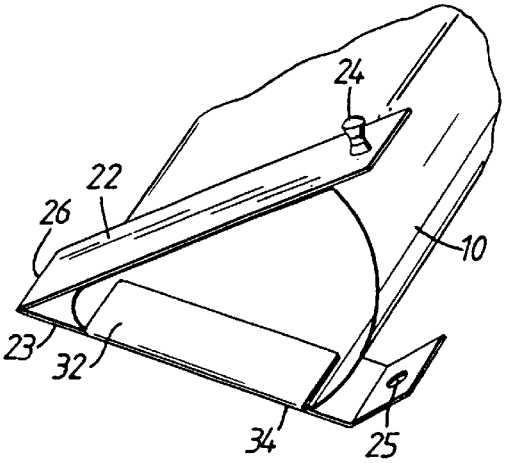

The gripping means may be of any convenient construction. Examples of gripping means are illustrated in FIGS. 4*a*, 4*b*, 4*c* and 4*d*. FIG. 4*a* illustrates a gripping means comprising first and second strips 22, 23 in which ends 30, 31 respectively of the strips are formed such that the ends 30 of one strip 22 may be engaged and retained by a snap action with the ends 31 of the other strip 23. FIG. 4*b* illustrates gripping means in which one strip 22 is formed with projections 24 which are an interference fit in apertures 25 in the other strip 23. If desired, as shown in FIG. 4*c*, the strips 22, 23 may be joined at one end by a hinge connection 26 and inter engaging means such as shown in FIG. 4*a* or FIG. 4*b* provided on the free ends of the strips.

The gripping means 13, 16 may be provided separately from the tube 10 and be positioned on the tube by the person carrying out the hair treatment or one or both gripping means may be secured to the tube 10 at or adjacent the ends thereof. The gripping means may be secured to the tube in any convenient manner, for example by adhesive, by welding or by clamping of the wall of the tube between a strip 23 and a cooperating element 32. The strips 22, 23 may be formed integrally with co-operating elements 32 and formed to fold lengthwise along an integral hinge 34 (FIG. 4*c*) to clamp the wall of the tube within the fold.

Figure 4D:
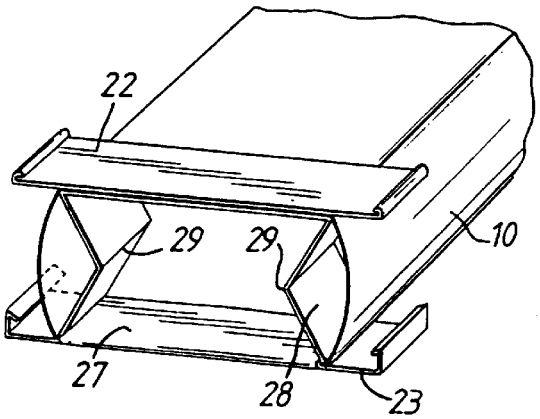

Alternatively, as shown in FIG. 4*d*, an element 27 may be located within the tube and the strips 22, 23 secured to parts 28 of the element such as to secure the wall of the tube between the strips and the element. The parts 28 of the element 27 are formed, for example by hinge connections 29 such as to collapse when the strips 22, 23 are urged toward one another and secured together to grip the hair therebetween. It will be appreciated that the strips 22, 23 are formed so as to be sufficiently rigid to apply the required pressure to the hair to prevent slipping of the ends of the tube relative to the hair.

The gripping means may be formed with grooves and ridges or teeth, indicated by 33 in FIG. 4*b*, or in some other manner to increase the frictional forces acting on the hair gripped thereby.

If desired the gripping means may be constructed so as to be bistable, having an open state to permit the hair to be inserted into the tube and to snap into a closed hair gripping state by application of manual pressure. The gripping means would be releasable from its closed state by appropriate pressure to its open state to permit removal of the device 10 from the set tress of hair after completion of treatment thereof. For example, the parts 28 of FIG. 4*d* may be formed such that although they collapse under pressure, the parts 28 are sufficiently resilient as to return to a non-collapsed state when the pressure is removed. Thus the parts 28 initially hold the strips 22, 23 spaced apart to permit insertion of the hair, permit the strips 22, 23 to be moved into a hair gripping state and, upon release of the strips 22, 23 from another, exert resilient force to move the strips 22, 23 apart from one another to release the hair.

The gripping means may be formed as mouldings of synthetic plastics material. However it is to be understood that the gripping means may be of any suitable construction and may be formed in any manner desired provided that such gripping means is capable of securing the ends of the tube to the tress of hair with sufficient frictional force to prevent slipping of the tube relative to the tress of hair. In the embodiment described hereinbefore, the first and second gripping means are located adjacent the ends of the tube, however the gripping means may be located inwardly of the ends of the tube at locations spaced from the ends of the tube provided that, when the tube is in its extended state, the gripping means are spaced apart along the length of the extended tube.

I claim:

1. A method of treating hair including the steps of inserting a tress of hair into a tube of resiliently extendible material; securing the tube at a first lengthwise location thereof to the tress of hair; extending said tube lengthwise; while said tube is so extended, securing the tube at a second location thereof spaced lengthwise of the first location to the tress of hair; permitting the tube to return to an unextended state to thereby cause the hair contained in the tube to assume a waved form; and subjecting the hair contained within the tube to a chemical hair treatment substance effective to retain the hair substantially in said waved form.

2. A method of treating hair as claimed in claim 1 including the step of applying the chemical hair treatment substance to the tress of hair prior to inserting the tress of hair into the tube.

3. A method treating hair as claimed in claim 1 including the step of applying the chemical hair treatment substance to the tress of hair while the tress of hair is contained within the tube.

4. method of treating hair including the steps of inserting a tress of hair into a length of tube of resiliently extendible material in an initial state such that the tress of hair extends lengthwise through the length of tube and a free end of the tress of hair extends beyond said length of tube in said initial state; securing a first end of the tube relative to a first lengthwise location of said tress; extending said length of tube lengthwise from said initial state to an extended state to enclose at least a part of said free end of said tress within the extended length of tube; securing a second end of said length of tube, remote from said first end, relative to a second lengthwise location of said tress of hair spaced lengthwise along the tress of hair from the first location while said length of tube is in said extended state; releasing the length of tube so that resilience of the length of tube causes the length of tube to contract lengthwise from said extended state toward said initial state thereby to cause the tress of hair contained within the length of tube to be contracted into a waved form; and subjecting the tress of hair contained within the length of tube to a hair treatment substance effective to retain the tress of hair substantially in said waved form.

5. A method of treating hair as claimed in claim 4 including the step of applying the hair treatment substance to the tress of hair prior to inserting the tress of hair into the length of tube.

6. A method treating hair as claimed in claim 4 including the step of applying the hair treatment substance to the tress of hair while the tress of hair is contained within the length of tube.

7. A method of treating hair as claimed in claim 4 wherein the tress of hair extends from a scalp; the first lengthwise location is adjacent said scalp and the second lengthwise location is remote from the scalp.

8. A method of treating hair including the steps of inserting a tress of hair through a length of resiliently extendible tube in an initial state such that the tress of hair extends lengthwise through the length of tube and a free end of the tress of hair extends beyond said length of tube; locating a first end of the tube relative to a first lengthwise location of said tress; extending said length of resiliently extendible tube lengthwise from said initial state to an extended state to enclose at least a part of said free end of said tress within the extended length of resiliently extendible tube; releasing the length of resiliently extendible tube so that the length of resiliently extendible tube contracts lengthwise from said extended state toward said initial state while maintaining a second end of said length of resiliently extendible tube, remote from said first end, located relative to a second lengthwise location of said tress of hair spaced lengthwise along the tress of hair from the first location thereby contracting the tress of hair contained within the length of resiliently extendible tube into a waved form; and subjecting the tress of hair contained within the length of resiliently extendible tube to a hair treatment substance effective to retain the tress of hair substantially in said waved form.

9. A method of treating hair as claimed in claim 8 including the step of applying the hair treatment substance to the tress of hair prior to inserting the tress of hair into the length of tube.

10. A method treating hair as claimed in claim 8 including the step of applying the hair treatment substance to the tress of hair while the tress of hair is contained within the length of tube.

11. A method of treating hair as claimed in claim 8 wherein the tress of hair extends from a scalp; the first lengthwise location is adjacent said scalp and the second lengthwise location is remote from the scalp.

12. A method of treating hair including the steps of enclosing at least a part of a tress of hair within a length of resiliently extendible tube stretched lengthwise, said tress of hair extending lengthwise of said stretched length of resiliently extendible tube; releasing the stretched length of tube so that the length of tube contracts lengthwise while maintaining first and second ends of the length of tube located relative to locations spaced apart along the tress of hair to cause that part of the tress of hair enclosed in the length of resiliently extendible tube to be contracted into a waved form.

* * * * *